US011609057B2

(12) United States Patent
Caudle et al.

(10) Patent No.: US 11,609,057 B2
(45) Date of Patent: Mar. 21, 2023

(54) CIRCUMFERENTIAL RIFLING

(71) Applicants: Carl E Caudle, Moses Lake, WA (US); Nathanel J Caudle, Moses Lake, WA (US)

(72) Inventors: Carl E Caudle, Moses Lake, WA (US); Nathanel J Caudle, Moses Lake, WA (US)

( * ) Notice: Subject to any disclaimer, the term of this patent is extended or adjusted under 35 U.S.C. 154(b) by 0 days.

(21) Appl. No.: 17/552,115

(22) Filed: Dec. 15, 2021

(65) Prior Publication Data

US 2022/0187041 A1 Jun. 16, 2022

Related U.S. Application Data

(60) Provisional application No. 63/125,911, filed on Dec. 15, 2020.

(51) Int. Cl.
*F41A 21/18* (2006.01)

(52) U.S. Cl.
CPC ..... *F41A 21/18* (2013.01)

(58) Field of Classification Search
CPC ..... F41A 21/18
USPC ..... 42/78; 89/14.7
See application file for complete search history.

(56) References Cited

U.S. PATENT DOCUMENTS

| | | | | | |
|---|---|---|---|---|---|
| 835,482 | A * | 11/1906 | Vulpius | F41A 21/18 | 42/78 |
| 1,275,028 | A * | 8/1918 | Holter | F41A 21/18 | 42/78 |
| 2,293,114 | A * | 8/1942 | Carter | F41A 21/18 | 89/14.05 |
| 3,616,562 | A * | 11/1971 | Burgsmüller | F41A 21/18 | 42/8 |
| 3,643,364 | A * | 2/1972 | Koch | F41A 21/18 | 42/78 |
| 4,437,251 | A * | 3/1984 | Gorman | F41A 21/18 | 42/78 |
| 2012/0180362 | A1* | 7/2012 | Feddersen | F41A 21/18 | 42/78 |
| 2015/0007479 | A1* | 1/2015 | Kunau | F41A 21/18 | 42/78 |

FOREIGN PATENT DOCUMENTS

| | | | | |
|---|---|---|---|---|
| EP | 3742103 | A1 * | 11/2020 | |
| WO | WO-2017220348 | A1 * | 12/2017 | F41A 21/18 |

* cited by examiner

*Primary Examiner* — Bret Hayes

(57) ABSTRACT

A novel rifling is disclosed, wherein a plurality of arc segments are disposed equally about the bore of a gun barrel, when viewed in cross-section. The surface of each arc segment comprises a bearing surface that imparts a spin on a projectile moving down a length of the gun barrel.

18 Claims, 10 Drawing Sheets

PRIOR ART

PRIOR ART

PRIOR ART

CONVENTIONAL RIFLING

POLYGONAL RIFLING

MULTI-RADIAL SABATTI RIFLING

PRIOR ART

CONVENTIONAL RIFLING

ENFIELD RIFLING

HYBRID RIFLING

POLYGONAL RIFLING

RATCHET RIFLING

CIRCUMFERENTIAL RIFLING

PRIORITY CLAIM AND CROSS-REFERENCE TO RELATED APPLICATION

This application claims the benefit under 35 U.S.C. § 119(e)(1) of U.S. Provisional Application No. 63/125,911, filed Dec. 15, 2020, which is hereby incorporated by reference in its entirety.

BACKGROUND

A conventional firearm generates pressurized combustion gases chemically through exothermic oxidation of combustible propellants, such as gunpowder, which generates propulsive energy by breaking molecular bonds in an explosive production of high temperature gases. In modern firearms, the combustion gases are generally formed within a cartridge comprising the projectile inserted into a casing containing the fuel. This propulsive energy is used to launch the projectile from the casing, and thus from the firearm.

Abundant gas pressure (e.g., often as much as 65,000 psi, and upwards of 80,000 psi in some cases) may be generated from burning gunpowder by conversion of solids (carbon and sulfur) to gas, combined with heat expansion during the ignition and combustion processes. Heat is generated by the chemical reaction (e.g., around 4000° F.) that raises the temperature of many components of the firearm, and that can cause the barrel to reach very high temperatures (e.g., around 700°-900° F.) at the end of the barrel in some cases).

Accordingly, the chamber/barrel pressure of a conventional firearm is characterized by expanding gases and high heat, which provide the energy for propelling a bullet from the firearm. The high pressures of conventional firearms result in abundant forces, which cause rapid bullet accelerations (e.g., upwards of 4,000 ft./sec. in some cases). By comparison, the lowest pressure rifle cartridges may be black powder cartridges of yesteryear and certain rimfire cartridges. Some of these lesser firearm cartridges still generate barrel pressures of 15,000-20,000 psi, or 20,000-25,000 psi for rimfire. For example, a conventional rifle chambered for a 0.22 long rifle (LR) cartridge fires a 40-grain bullet at approximately 1200 ft/sec.

When a firearm is discharged the pressure within the chamber rises significantly, almost instantaneously, as the solid fuel is ignited. Pressure (and heat) within the chamber and barrel builds as the burning fuels increase the gases within, and as those gases expand with the heat. The bullet is first forced onto the rifling of the barrel, which is smaller in size than the bullet's diameter. Accordingly, this causes the bullet to deform, compressing the bullet's core and engraving the rifling shape into the surface of the bullet. This creates a thread-like shape or deformation (e.g., up to 0.015" deep for each rifling shape) around the surface of the bullet. The bullet is then expelled from the barrel of the firearm, with the rifling of the barrel causing the bullet to mechanically spin.

The combustion gases continue to expand, however, the pressure drops within the barrel as the end of the barrel opens to the atmosphere, freeing the gases when the bullet leaves. In many cases, the still-burning fuel continues to produce heated gases after the bullet is expelled, which can result in a "muzzle flash" at the end of the barrel.

BRIEF DESCRIPTION OF THE DRAWINGS

The detailed description is set forth with reference to the accompanying figures. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Traditional rifling was designed for projectiles made from lead or similar soft materials, and continues to be used with the metal jacketed projectiles that have come since. Both materials are similar, however, in that the cores are malleable, allowing the rifling to compress, expand, and to engrave the projectile with the shape of the rifling, often deeply.

In contrast, modem projectiles made of solid harder metals and rigid composite materials resist deformation and may not expand, compress, or allow the traditional rifling features to engrave or reshape the projectile. Further, newer projectile cartridges often include propellants that generate more energy for increased velocity. Accordingly, use of these newer projectiles can cause increased heat and can raise back-pressure in the firing chamber. As the intended and actual velocity of new projectiles increases, the ability for traditional rifling to function with these modern projectiles diminishes.

When used with softer materials such as lead and metal jacketed lead, the sudden forceful pushing of the bullet onto the rifling, and the resulting deformation of the bullet can cause the bullet to be slightly off of its center axis when it travels down the bore. Spinning on an axis that is off from the central longitudinal axis of the bullet induces the bullet to wobble, resulting in a less stable flight. This is especially notable when the bullet transitions from supersonic to subsonic flight. Further, the rifling can remove or displace material from the bullet unequally, relative to the central longitudinal axis during engraving. This can cause the mass of the bullet to be unequal relative to the central longitudinal axis, creating a center of gravity that is off the central longitudinal axis, and also inducing a yaw wobble on the spinning bullet. The result is a loss in accuracy and a loss in flight range.

Even with softer projectiles, traditional rifling's screw shapes and polygonal shapes are sensitive to projectile length, weight, and bearing surfaces, often having bends or corners to grip the bullet while deforming its shape to hold it. The various rifling features result in numerous surfaces that cause drag on the bullet's surface, which increases heat and has a detrimental effect on velocity, pressure in the barrel, and performance. Projectiles come in many different weights and lengths and travel at different velocities. Each projectile optimally needs a different twist rate to maximize the projectile's stability. With sub-optimal rifling and/or twist rate, velocity and accuracy are sacrificed, including super-high velocities that can be possible with modem propellants.

Prior Art Examples

Figure 1A:
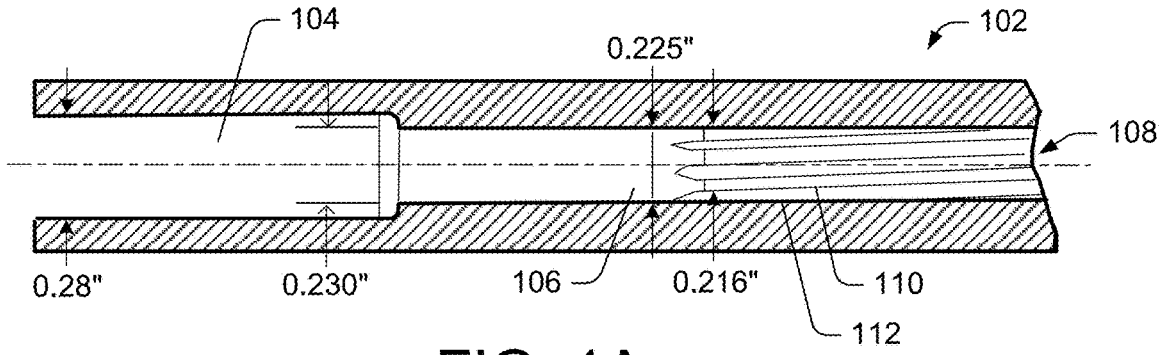
FIGS. 1A-1C are prior art diagrams comparing the dimensions of a .22 caliber cartridge to the dimensions of the firing chamber and barrel of a firearm designed to propel the bullet.
Figure 1B:
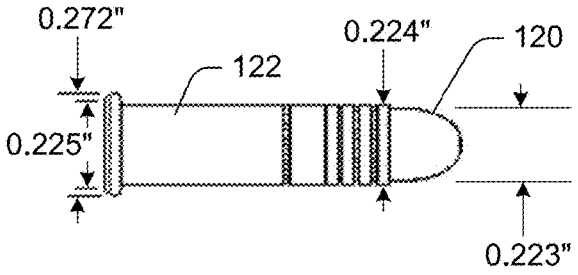
Figure 1C:
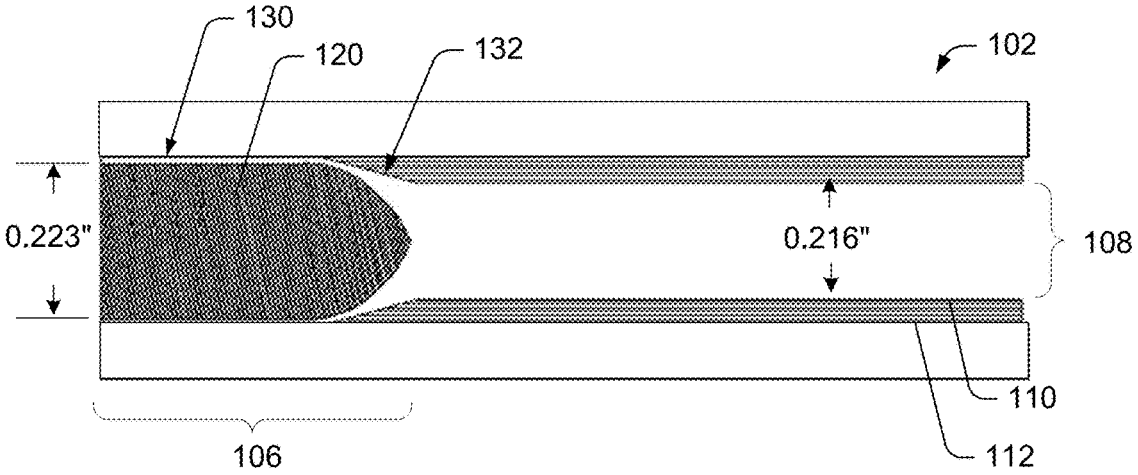

FIG. 1A shows a cross-section of a portion of an example .22 caliber firearm barrel 102, including the chamber 104, throat 106, and bore 108. FIG. 1B shows the dimensions of a typical .22 cartridge, and FIG. 1C shows a detail view of the bullet 120 within the throat 106 at the entrance to the bore 108. Referring to FIGS. 1A-1C, the dimensions of the bullet 120 (at FIG. 1B) can be compared to the dimensions of the chamber 104, throat 106, and bore 108 (at FIGS. 1A and 1C). While .22 caliber dimensions are shown, the discussion is also relevant to firearms of other calibers and their respective ammunition, with their associated dimensions.

The chamber 104 is the first portion of the barrel 102, and it has an interior diameter that is sized larger than the outer diameter of the bullet 120 and casing 122 for easy loading of the bullet 120 cartridge. The throat 106 is the section of the barrel 102 that accommodates the bullet 120, and has an interior dimension (e.g., 0.225") just over the outer dimension of the bullet 120 (e.g., 0.223"). The bore 108 is the travel path for the bullet 120 down the length of the barrel 102, which includes the rifling lands 110 and grooves 112.

The rifling lands 110 and grooves 112 are disposed down the length of the barrel 102 in a helical arrangement, in order to induce a spin on the bullet 120 as it travels down the length of the barrel 102. While the dimension from groove 112 to groove 112 (e.g., 0.225") is just larger than the outer dimension of the bullet 120 (e.g., 0.223"), the actual bore 108 comprises the inside diameter of the lands 110 (see FIGS. 2A and 2B), and it has an inside dimension (e.g., 0.216") that is smaller than the outer dimension of the bullet 120 (e.g., 0.223").

Referring to the detail of FIG. 1C, the throat 106 is comprised of the freebore 130 and the leade 132. The freebore 130 has the greater dimension of the throat 106 (e.g., 0.225"). As shown at FIG. 1C, the leade 132 is a tapered section of the throat 106 that transitions from the diameter of the freebore 130 (e.g., 0.225") to the smaller dimension of the bore 108 (e.g., 0.216"). In many cases, the leade 132 comprises a taper on the initial portion of the rifling lands 110.

For hundreds of years, the leade 132 has been used to help guide and force a bullet 120 into the center of a bore 108. Its shape is used to try to keep the bullet 120 straight in the barrel 102, as it also begins to engrave the rifling shape into the bullet 120. Hundreds of foot-pounds of pressure are required to engrave the bullet 120 and get it started down the bore 108. Initial acceleration from the exploding propellant can go from zero to 4,000 feet per second in some cases. The massive impact on the bullet 120 caused by the propellant violently deforms the bullet 120 to force it into the bore 108.

During ignition with a compressible bullet 120 (e.g., lead or copper jacketed lead bullet 120), the extreme forces resulting from the combustion process (e.g., about 50,000 to 65,000 psi) deforms the bullet 120, first by compressing portions of the bullet 120 against the leade 132 and the rifling lands 110, and then by expanding other portions of the bullet 120 into the grooves 112 and pushing the bullet 120 into the bore 108. In the process, the lands 110 dig into the surface of the bullet 120 as the bullet is propelled down the bore 108.

Traditional rifling patterns impart the shape of the rifling onto the bullet 120 which disrupts the airflow around the bullet 120 as it travels through the air. This creates drag and instability, especially when the bullet 120 transitions from super-sonic to sub-sonic velocities.

Figure 2A:
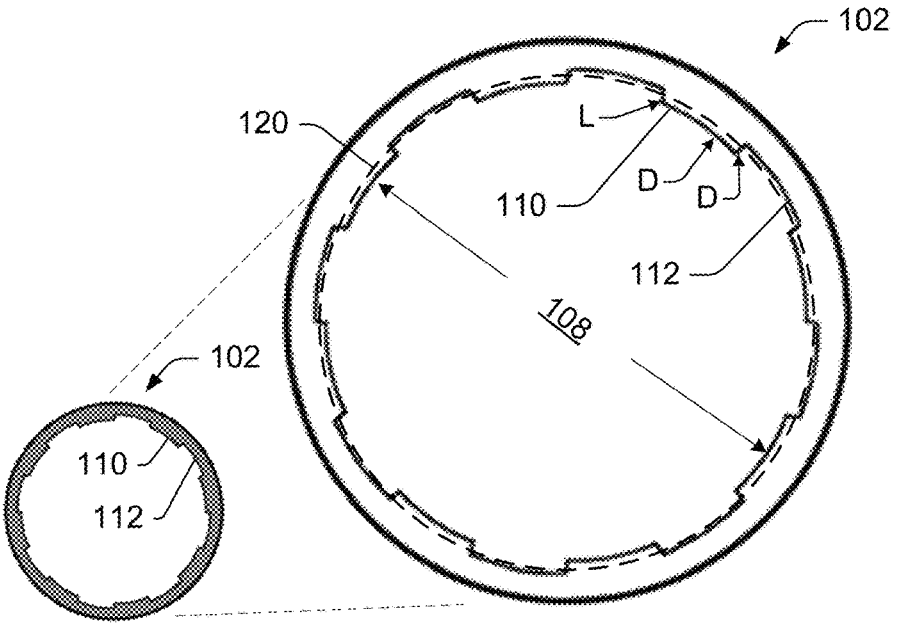
FIG. 2A PRIOR ART
FIGS. 2A and 2B are prior art diagrams showing the details of two common rifling patterns.
Figure 2B:
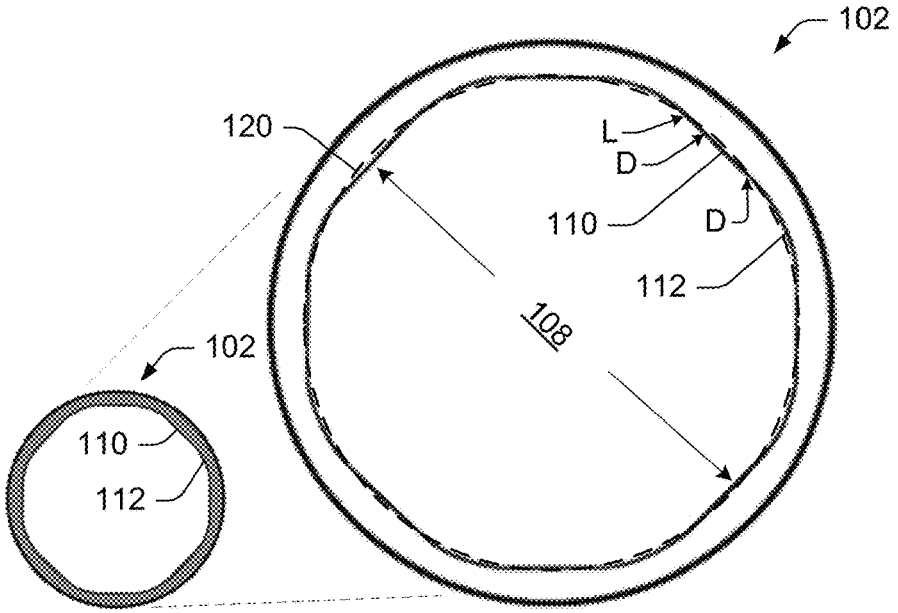

FIGS. 2A and 2B show two examples of end views of the barrel 102, and include example section views of the lands 110 and grooves 112 of the rifling. Two common types of rifling are shown: an Enfield-style rifling at FIG. 2A and a polygonal-style rifling at FIG. 2B. The rifling shape of each is generally consistent and rotates around the perimeter of the bore 108 for the length of the barrel 102, in a helix or screw arrangement, with the lands 110 and grooves 112 like the threads of a screw having surfaces protruding into the bore 108. The rate of rotation per length of barrel 102 (e.g., pitch) determines the speed of the spin on the bullet 120. The principle of these two rifling examples, as well as a myriad of other similar rifling types with lands 110 and grooves 112 (see FIGS. 3A-6B), is comparable. The goal is to seal the bore 108 (to reduce blow-by) and to induce a spin on the bullet 120.

FIGS. 2A and 2B also show an overlay of an example bullet 120 (using dashed lines) as it sits in the bore 108 while it moves down the barrel 102. The outer diameter of the bullet 120 fits within the grooves 112 of the rifling, while the lands 110 bite into the surface of the bullet 120. In many cases, the height of the lands 110 relative to the grooves 112 can be between 0.005" and 0.015".

Accordingly, the bullet 120 is deformed (e.g., by compression and expansion) and engraved as it is forcefully pushed into the rifling by the expanding combustion gases. Further, material is generally removed from the bullet 120 during engraving and can be deposited in the grooves 112 of the rifling due to the lands 110 cutting into the surface of the bullet 120 and added friction from bullet material being forced to bend or flatten. This can necessitate frequent cleaning of the barrel 102 to prevent unsafe high pressures from occurring from narrowing the dimensions of the bore 108. This material depositing effect can be greater for softer bullet materials, such as lead, for example.

Figure 3A:
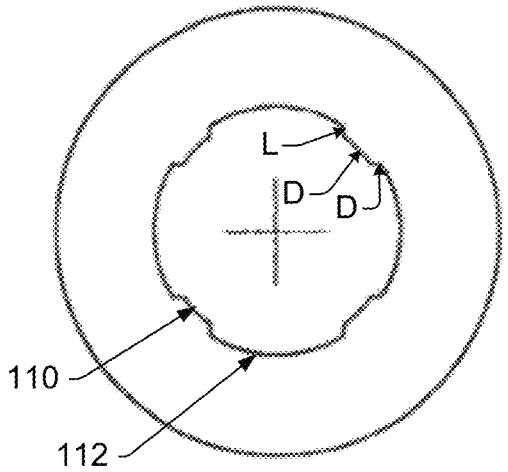
FIGS. 3A-4E show several prior art rifling patterns.
Figure 3B:
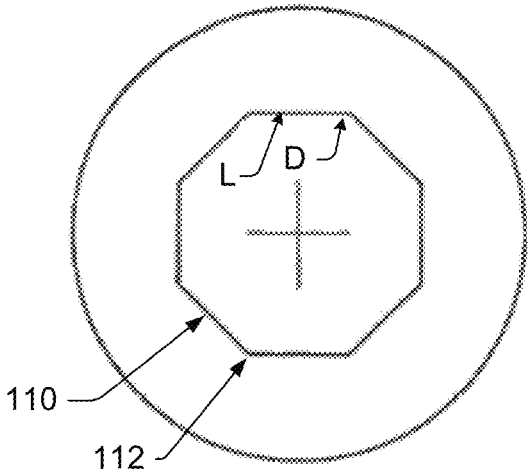
Figure 3C:
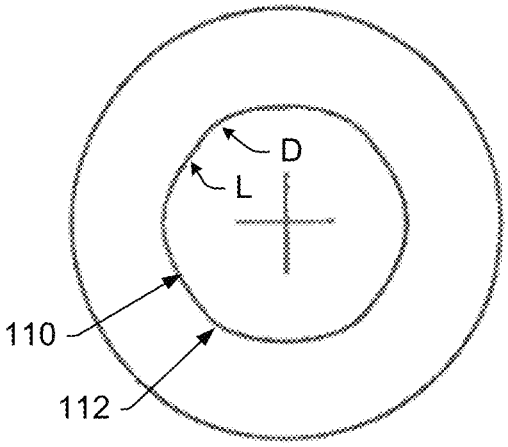
Figure 4A:
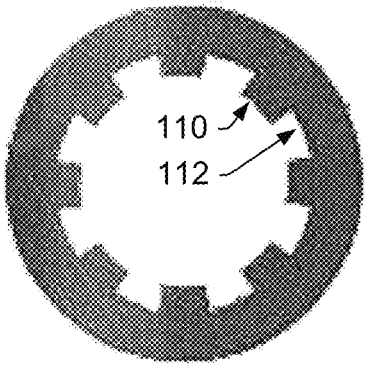
Figure 4B:
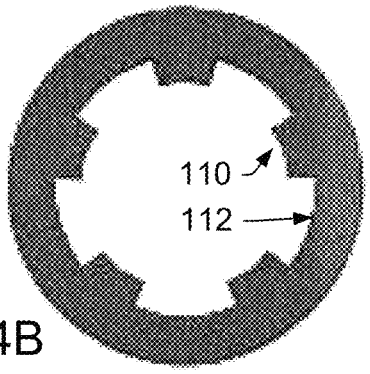
Figure 4C:
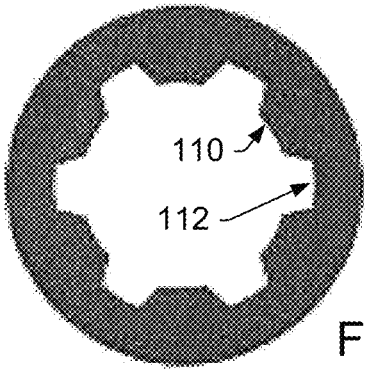
Figure 4D:
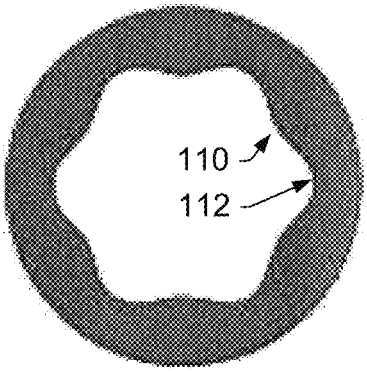
Figure 4E:
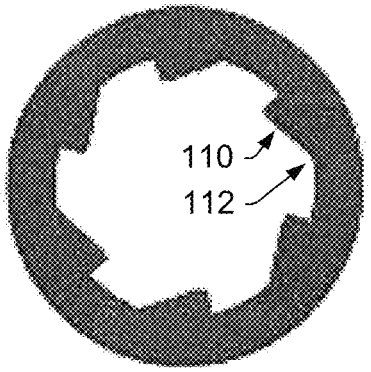
FIG. 4E PRIOR ART

FIGS. 3A-6B show some additional rifling patterns that have been used or are in use today. FIG. 3A shows a Conventional or "Enfield" style rifling that has been described with reference to FIG. 2A. The number of lands 110 and grooves 112 may vary, but the principal of operation is the same. FIG. 3B shows a Polygonal rifling has also been shown with reference to FIG. 2B. In cross-section, polygonal rifling includes a plurality of line segments forming a polygon-shaped bore. Any number of line segments, arcs, and flats may be used to form the polygon, with the principal being the same. The lands 110 comprise the flat portions of the line segments and the grooves 112 comprise the vertices where the segments meet. FIG. 3C shows a Multi-radial or "Sabath" type rifling comprised of alternating the segments of two circles. Segments from a larger-radius circle comprise the lands 110 and segments of a smaller-radius circle form the grooves 112. These larger and smaller circle segments alternate to form a rifling that is similar to a polygonal rifling pattern. Additionally, at least one Newton-Pope rifling pattern also resembles the multi-radial pattern shown at FIG. 3C. This pattern dates back to at least 1866, as applied by Metford. Although it resembles polygonal rifling, the smaller arcs of the rifling are in effect a reverse land, with corners used as lands. This rifling bends and folds the bullet 120 to grip and deform it.

FIG. 4 shows additional rifling patterns that can be thought of as essentially variations of the rifling patterns of FIGS. 2A-3C. Like those, it can be seen that the rifling forces the deformation of the bullet 120, including compressing, expanding, and engraving, the bullet 120, and contributing to drag on the bullet 120 (often in an unbalanced way).

The rifling patterns of FIGS. 2A-3C are marked with an L to show the leading surface that protrudes into the barrel's bore 108 (generally of a land 110), that mechanically imparts a spin on the bullet 120, and a D to show examples of the drag surfaces that are created during the formation of the rifling shape as the bullet 120 is deformed. The leading edge L is the only part of the rifling that imparts a rotational force on the bullet 120. The remaining geometry/shape of the rifling drags through and across the body of the bullet 120 causing distortion, friction, heat, and upsetting the core axis of the bullet 120, thus changing the axial point around which the bullet 120 spins. Drag surfaces may include the raised surface of a land 110, the trailing edge of a land 110, or the surface of a groove 112.

The drag surfaces can add friction which can slow the bullet 120, add heat to the bullet 120 and to the barrel 102, and add wear to the bore 108, as well as remove material from the bullet 120 (and deposit the material in the bore 108). In each case, the efficiency of the shot can be diminished and the wear on the firearm can be increased.

Figure 5:
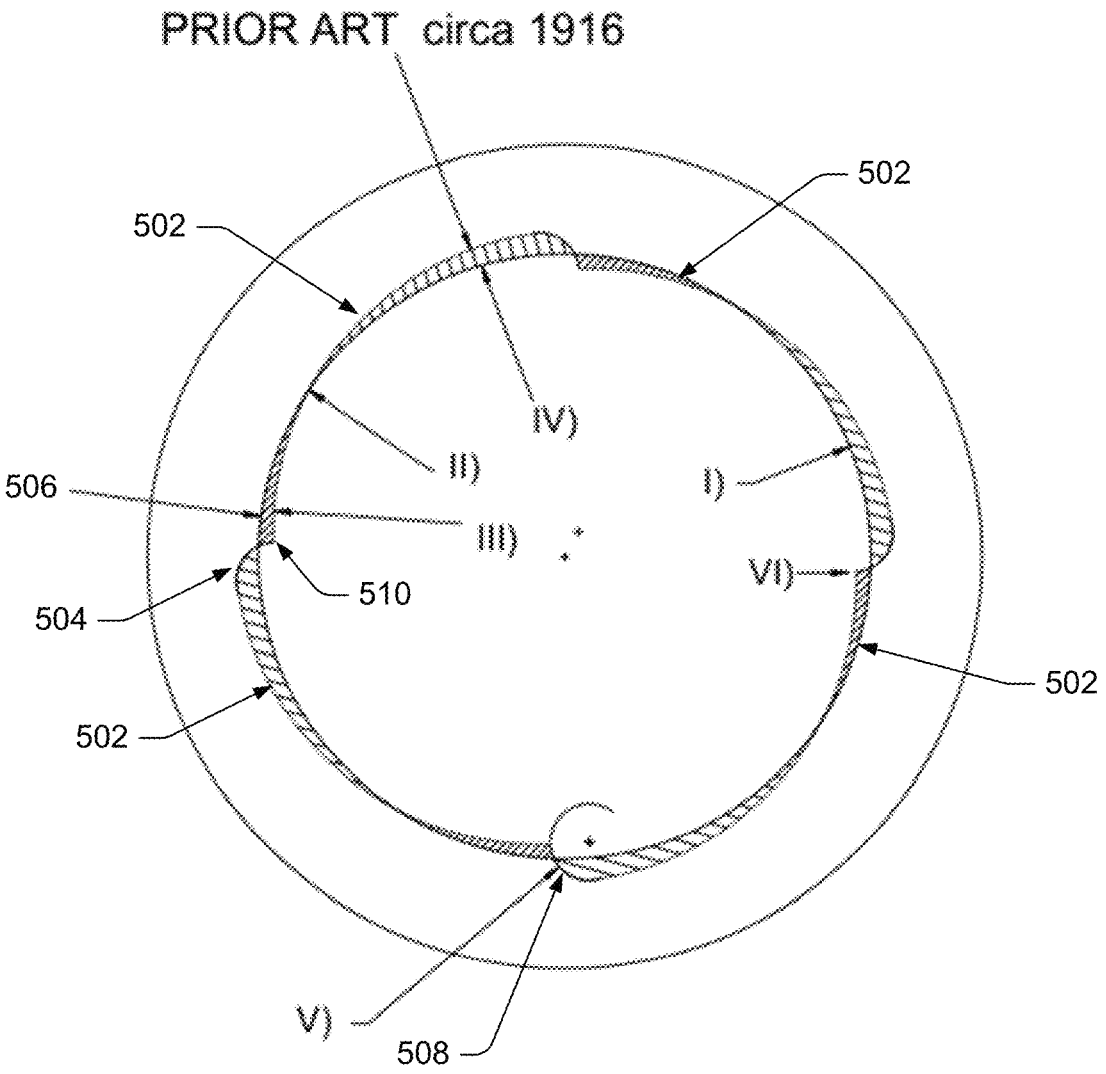
PRIOR ART FIG. 5
FIG. 5 is a diagram showing a prior art rifling pattern.

FIG. 5 shows a prior art rifling design to compare with the "claw rifling" pattern of the first implementation below. The prior art rifling shown at FIG. 5 uses a series of arc segments 502 arranged around the perimeter of the bore 108. However, the prior art arc segments 502 are flush with the bore 108 diameter at some point near mid-length of each arc segment 502. The first end 504 of each prior art arc segment 502 is outside the perimeter of the bore 108, forming an expansion area (IV). The second end 506 of each prior art arc segment 502 protrudes into the interior of the bore 108, forming a compression area (III). Each prior art arc segment 502 is joined to the adjacent arc segment 502 by an arc 508 comprising a portion of a circle having a radius (V). The vertex 510 of each prior art arc segment 502 and each circle portion 508 forms a sharp land (VI).

The rifling at FIG. 5 was designed to force a bullet 120 to expand at ignition 0.006" per groove, for a total of 0.012" beyond actual bullet 120 diameter. The rifling was also designed to compress the bullet 120 (on the short diameter sides). The geometry was intended for soft (e.g., malleable) bullet 120 applications.

Unlike the "claw rifling" 700 shown below, the prior art rifling at FIG. 5 deforms and engraves the bullet 120. Thus, the prior art rifling pattern is more suitable for soft bullet 120 that are compressible and expandable, and is not suitable for hard metallic or composite bullet 120 that are not compressible or expandable. The prior art rifling includes areas that compress the bullet 120 (III), areas that expand the bullet 120 (IV), and sharp lands (VI) that engrave the bullet 120.

Figure 6A:
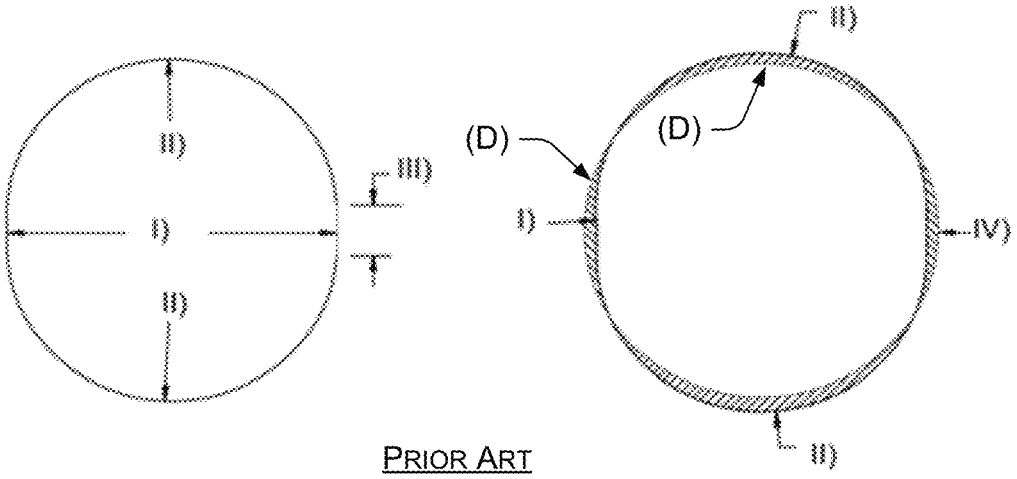
PRIOR ART FIG. 6A
FIGS. 6A and 6B are diagrams showing a prior art rifling pattern.
Figure 6B:
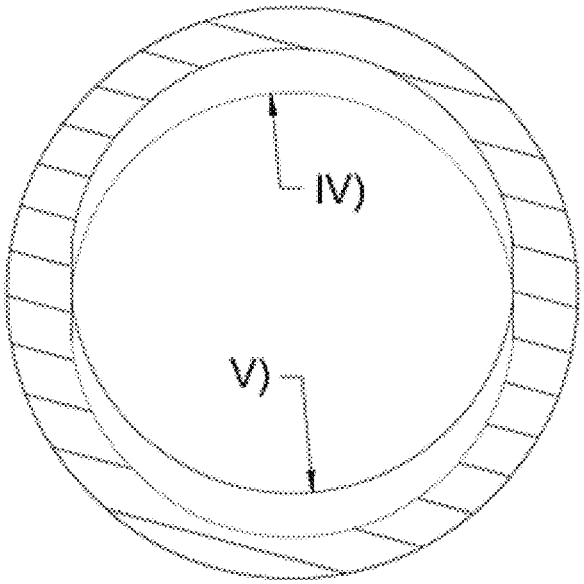
PRIOR ART FIG. 6B
Figure 7A:
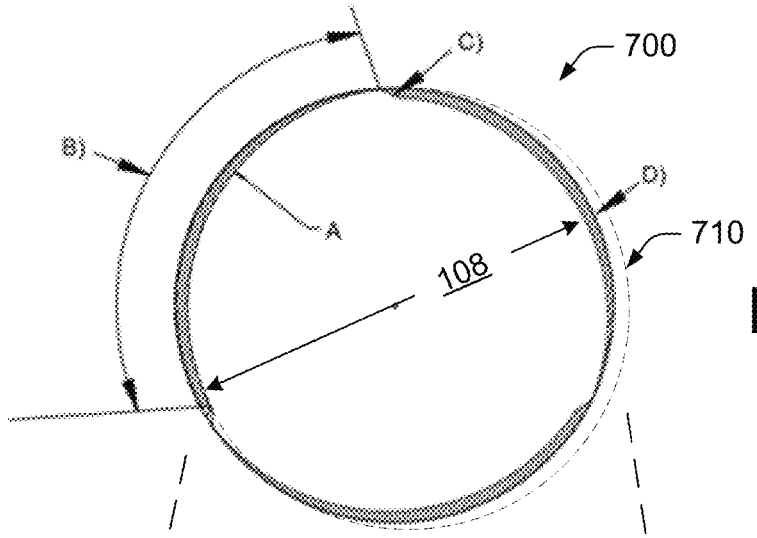
FIGS. 7A-7B show two views of a novel rifling, according to a first embodiment.
Figure 7B:
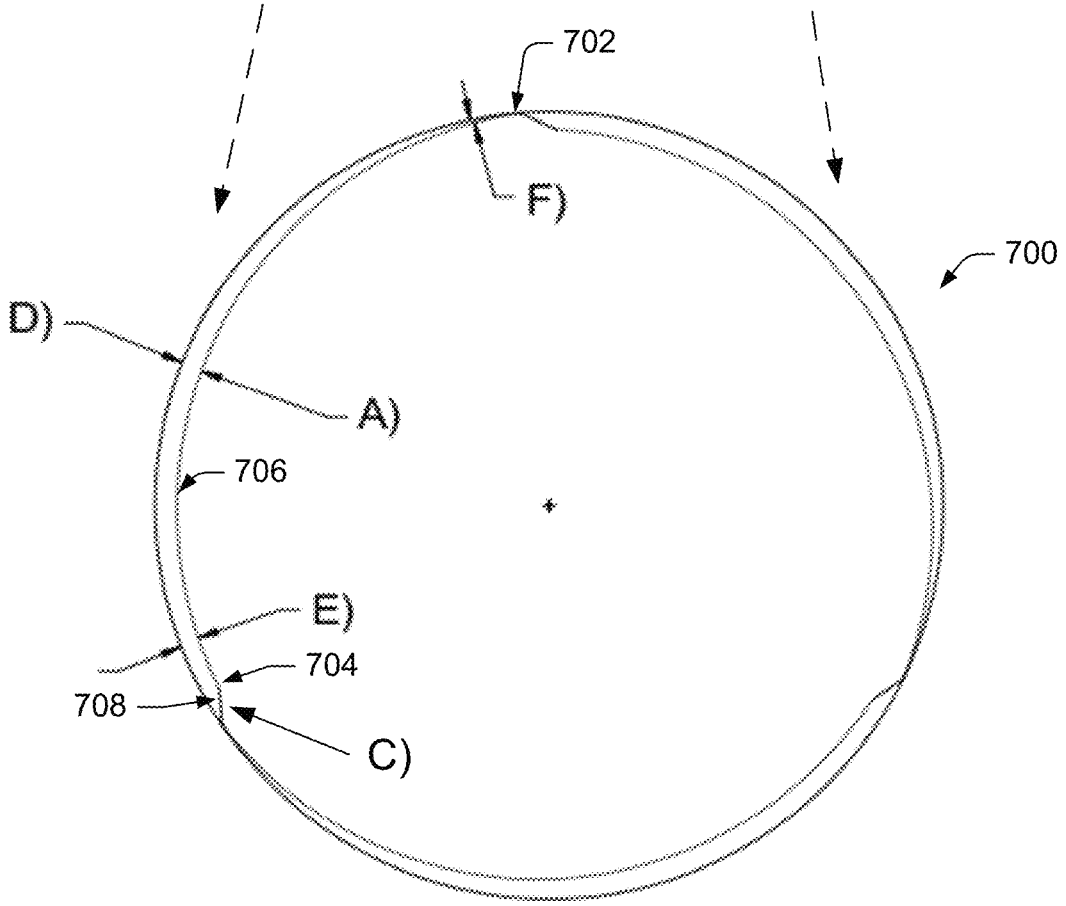
Figure 7C:
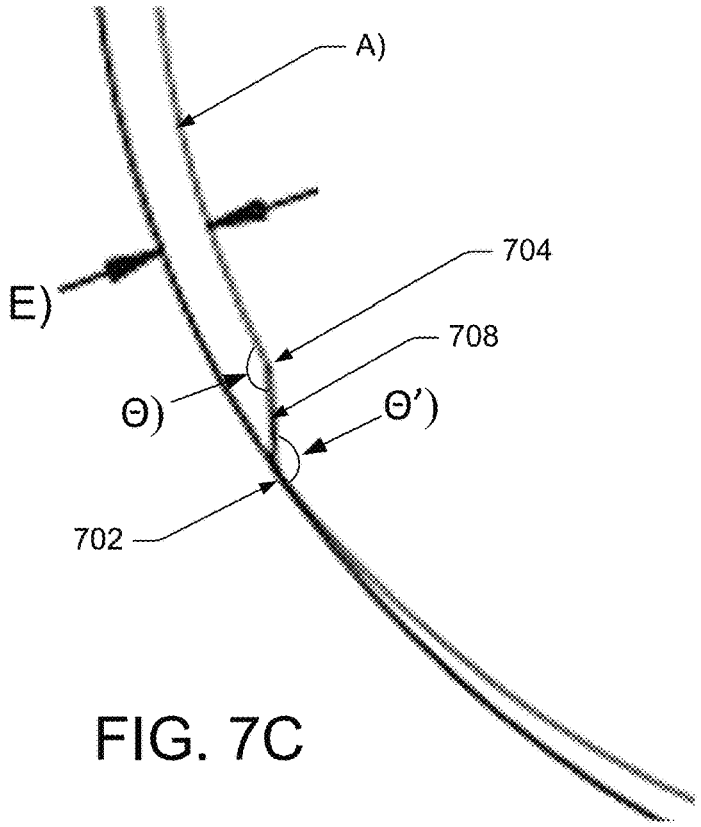
FIGS. 7C-7D show two close detail views of the novel rifling of FIGS. 7A and 7B, according to the first embodiment.
Figure 7D:
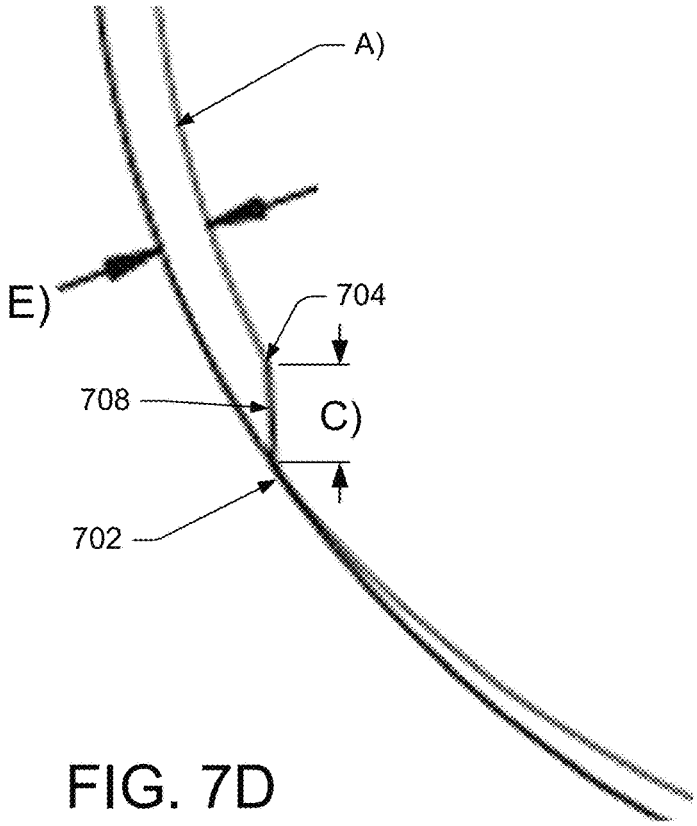

FIGS. 6A and 6B show another prior art rifling design, "the Lancaster Oval Bore," to compare with the "twisted bore rifling" 800 disclosed below. The prior art rifling at FIGS. 6A and 6B uses two circles (IV) and (V) superimposed on the bore 108, such that the result is an oval-shaped bore 108. The greater diameter of the oval (II) is longer than the diameter of the bullet 120, so it comprises an expansion region. The lesser diameter of the oval (I) is less than the diameter of the bullet 120, so it comprises a compression region. The actual diameter (D) of the bullet 120 (IV) is shown for comparison at FIG. 6A.

The Newton Pope oval, also known as the Lancaster oval bore, is the only rifling pattern to appear over the past 100 years, up until now. It was designed to try to compress the bullet 120 and reshape it into an oval (or more accurately a rectangle with rounded ends). It failed, as it distorted the bullet 120 and offered increased friction and poor stabilization. It was designed for compressible and expandable bullets 120, but not for the hard solid metallic and composite bullets 120 of today. The intent and application was different. Note that "The Caudle polygon rifling," as documented in U.S. patent application Ser. No. 16/908,522, is also of similar visual appearance. However, it was also intended to be used with compressible and expandable bullets 120.

Unlike the "twisted bore rifling" pattern 800 shown below, the prior art oval rifling deforms (compresses and expands) the bullet 120. Thus, the prior art oval rifling pattern is more suitable for soft bullets 120 that are compressible and expandable, and is not suitable for hard metallic or composite bullets 120 that are not compressible or expandable. The prior art oval rifling includes areas that compress the bullet 120 (III) and areas that expand the bullet 120 (II).

Each of these prior art rifling patterns, and other like rifling patterns, are optimally used with bullets 120 comprised of a compressible/expandable material (such as lead or some copper-jacketed lead). Bullets 120 made of materials that are less prone to compression or expansion, such as bullets 120 made from harder metals like copper, uranium or titanium, for example, may not work well or work at all with such rifling patterns.

Further, the use of some modern metallic or composite bullets 120 with prior art rifling like that shown above can result in problems including: excessive heat generation; loss in velocity; excessive erosion from modem propellants; tearing and stripping of the rifling lands 110 from the barrel's bore 108; excessive friction from bullet 120 drag on edges and surfaces of the rifling; limited bullet 120 velocity; very short usable life spans, and so forth.

Erosion and heat can destroy traditional rifling lands 110, particularly at the breech end of the barrel 102. Traditional rifling as shown above includes rifling lands 110 that are a thin ridge, and regardless of shape, they offer a thin surface that is easily eroded away. If the first ⅛ inch of the lands 110 wears or is burned away, the bullet 120 can be easily misaligned in the bore 108 and accuracy and flight characteristics can be compromised.

Erosion is caused by the heat and wear of friction of the bullet 120 traveling over the lands 110. The extreme pressure of combustion presses the lands 110 into the bullet 120 at least 0.004" per land 110. The projectile drags on the lands 110 the entire length of the barrel, with the greatest damage to the lands 110 when the projectile 120 first starts into the bore 108.

Erosion is also caused by the heat of combustion. This can be very destructive, since the propellant burns at 4,000° F. and common barrel steel melts at 2,200° F., with a eutectic point of 700° to 900° F. Given the thin surface area of the rifling lands 110, they can quickly erode away under such heat. Added to that is the heat due to the friction of the projectile 120, especially with newer, heavy metal projectiles, even with the short amount of time (e.g., milliseconds) that the bullet 120 is in the bore 108.

Example Embodiments

Disclosed herein are at least two embodiments of rifling patterns derived from the circumference of a circle, and as applied to the bore of a rifle. The disclosed rifling embodiments induce a spin on a bullet 120 without engraving the bullet 120 and without deforming the bullet 120. For example, neither rifling embodiment disclosed compresses the bullet 120 or expands the bullet 120.

The two embodiments are intended for use in modern firearms that shoot bullets 120 that have very limited compressibility or are non-compressible and non-expandable at the point of ignition. For instance, the material of the bullets 120 or its form may have very limited compressibility, may be non-compressible, may have very limited expandability, or may be non-expandable when subjected to the forces applied by modern firearms.

The two embodiments are optimized for use with solid, harder materials, long bullets 120, and super-high velocities. Bullets 120 are not engraved by deep or geometrically challenging shapes as with traditional rifling. Rather, the basis of the various embodiments of a rifling pattern is a circle, which conforms to the cross-sectional circle of a bullets 120.

Novel Rifling according to a First Embodiment

Referring to FIGS. 7A-7D, a first embodiment of a novel rifling includes a "claw rifling" pattern 700 (shown in cross-section). The cross-section of the claw rifling 700 is formed by disposing a quantity of arc segments (A), of equal length (B), each comprising a portion of the circumference of a same circle 710, equally around the periphery of a bore 108 that has the same diameter (D) as the intended bullet 120. For example, using the .22 caliber bullet 120 of FIG. 1B, the diameter of the bullet 120 is 0.223". Thus, the diameter (D) of the claw rifling 700 bore 108 is also 0.223" for a .22 caliber firearm. For other calibers of firearms, the diameter (D) of the claw rifling 700 bore 108 for the barrels 102 of those firearms corresponds to the diameter of the associated bullet 120 intended for the firearms. Where the bullet 120 diameter for a particular caliber of firearm ammunition varies, the diameter (D) of the claw rifling 700 bore 108 for the barrels 102 of those firearms can correspond to the diameter of each of the associated bullets 120 intended for the firearms. In other words, multiple barrel bores 108 can be manufactured, to match the ammunition that corresponds to it. Alternately, the diameter (D) of the claw rifling 700 bore 108 for the barrels 102 of those firearms can correspond to the largest diameter, the median diameter, or the smallest diameter of the intended bullets 120.

In some implementations, the circle 710 corresponding to the arc segments (A) also has the same radius as the intended bullet 120. Using the example above, the radius of the .22 caliber bullet 120 is 0.1115". Thus, the radius of the circle 710 corresponding to the arc segments (A) also has a radius of 0.1115". In other implementations, the circle 710 corresponding to the arc segments (A) may have a slightly smaller or slightly larger radius than the radius of the intended bullet 120. While three arc segments (A) are illustrated and described herein, the scope of the disclosure also includes any quantity of arc segments (A). In some implementations, the quantity of arc segments (A) comprises from 2 to 36 arc segments (A). In other implementations, the quantity of arc segments (A) comprises more than 36 arc segments (A).

The arc segments (A) are disposed such that each arc segment (A) extends nearly to the adjacent arc segment (A). A first end 702 of each arc segment (A) is flush with the diameter of the bore 108 (i.e., a distance (F) of 0.0000" offset to the bore 108). Each arc segment (A) has an offset from the bore 108 at the second end 704 of the arc segment (A) a predetermined distance (E) (e.g., 0.0003" to several thousandths of an inch for a .22 caliber firearm, which may be greater for larger caliber firearms). The pivot point of the angular offset is at the first end 702 of each arc segment (A). Accordingly, the second end 704 of each arc segment (A) protrudes into the bore 108 up to the predetermined distance (E).

Each arc segment (A) comprises a bearing surface 706, which is also a driving surface that imparts a rotation on the bullet 120 as the bullet 120 moves down the length of the barrel 102. Unlike traditional rifling, the bullet 120 is spun by the contact of the surface of the bullet 120 against the bearing surface 706. Thus, the plurality of arc segments (A) spiral in a helix pattern (rotate around the perimeter of the bore 108 in cross-section) over the length of the barrel 102. The angular offset (in thousandths of an inch or less) of each arc segment (A) provides a non-compressive and non-expansive surface to the outer surface of the bullet 120, as the arc segment (A) rotates around the perimeter of the bore 108, gripping the bullet 120 and imparting a spin onto the bullet 120. In various implementations, the rotational rate (relative to the length of the barrel 102) may be constant or varying, without losing the geometry of the rifling.

A rotational stop 708, comprising a very small flat or slightly curved segment joins the second end 704 of each arc segment (A) to the first end 702 of the adjacent arc segment (A). The rotational stop segment 708 has a length (C) that is a small fraction (e.g., between 1/50 and 1/100) of the length (B) of the arc segment (A). The rotational stop segment 708 angles from the second end 704 of the arc segment (A) at a very obtuse angle (θ) (e.g., between 100 and 180 degrees, for example 120 degrees) and meets the first end 702 of the adjacent arc segment (A) at a similar angle (θ').

The rotational stop segment 708 does not comprise a guide or a leading edge. The rotational stop 708 prevents slippage as the bullet 120 accelerates with super-high rotational forces at high velocities in excess of 3,800 fps. This rifling, comprising short bearing surfaces 706 with rotational stops 708, is optimized for harder bullets 120 at higher spin rates and higher muzzle velocities. For instance, the rotational stops 708 help prevent over-rotation of the bullet 120 during higher spin rates.

This modem rifling design works with modern super-high velocity bullets 120 that have small bearing (driving) surfaces. One example is a small diameter bullet 120 that is 2 inches long but has only ⅜" drive surface that actually contacts the bore 108. Such a bullet 120 cannot be stabilized with traditional rifling without causing a loss in velocity, and introducing a high coefficient of friction, high heat, and excessive projectile degradation. However, such a bullet 120 is stabilized using the claw rifling pattern 700 and its arced bearing surfaces 706.

Novel Rifling According to a Second Embodiment

Referring to FIGS. 8A-8D, a second embodiment of a novel rifling includes a "twisted bore" design 800 (shown in cross-section). The twisted bore rifling 800 comprises a bore 108 having the diameter (D) of the intended bullet 120, less a plurality of radius contact zones 802 that guide the bullet 120 and impart a spin on the bullet 120 without significantly compressing or expanding the bullet 120.

Figure 8A:
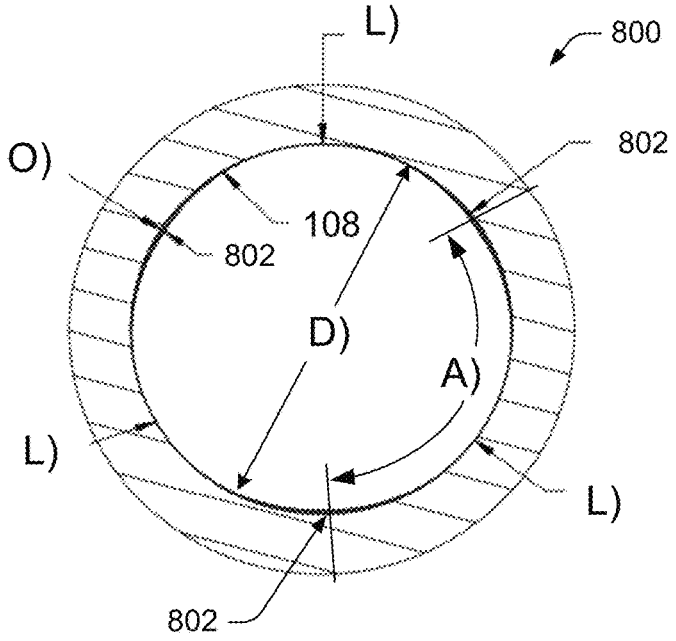
FIGS. 8A-8C show three views of a novel rifling, according to a second embodiment.
Figure 8B:
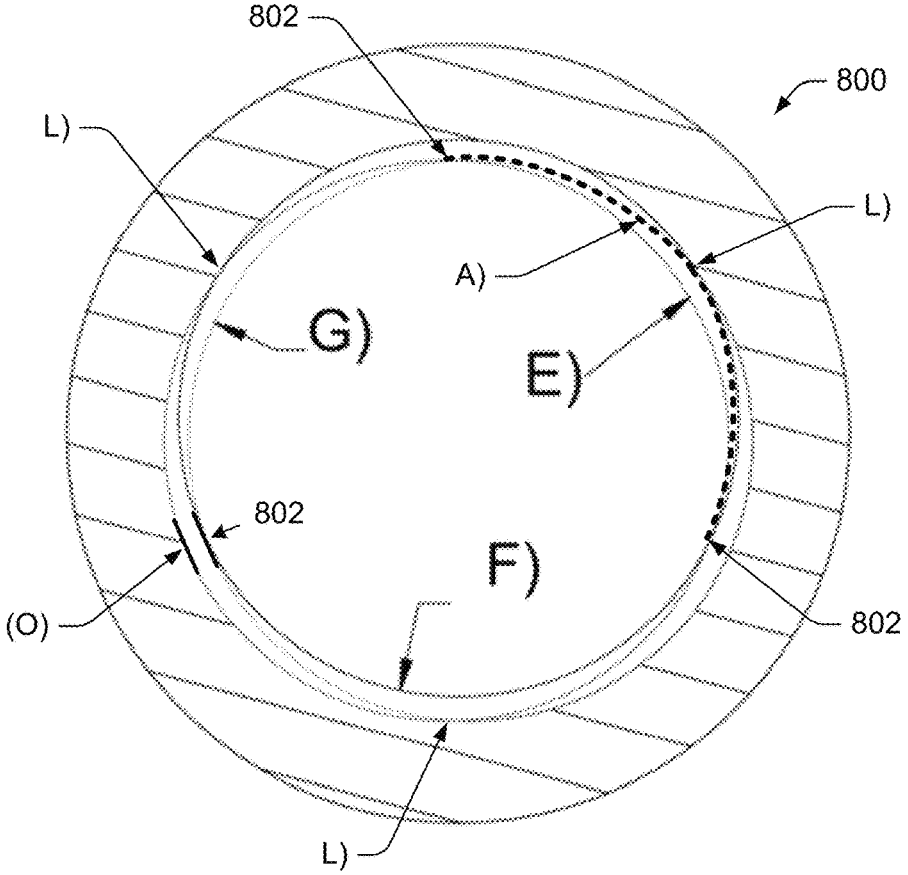
Figure 8C:
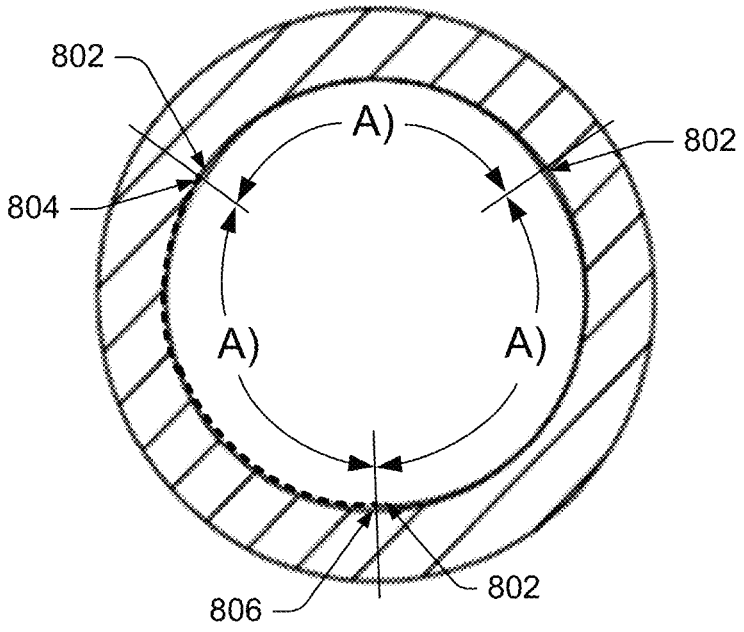
Figure 8D:
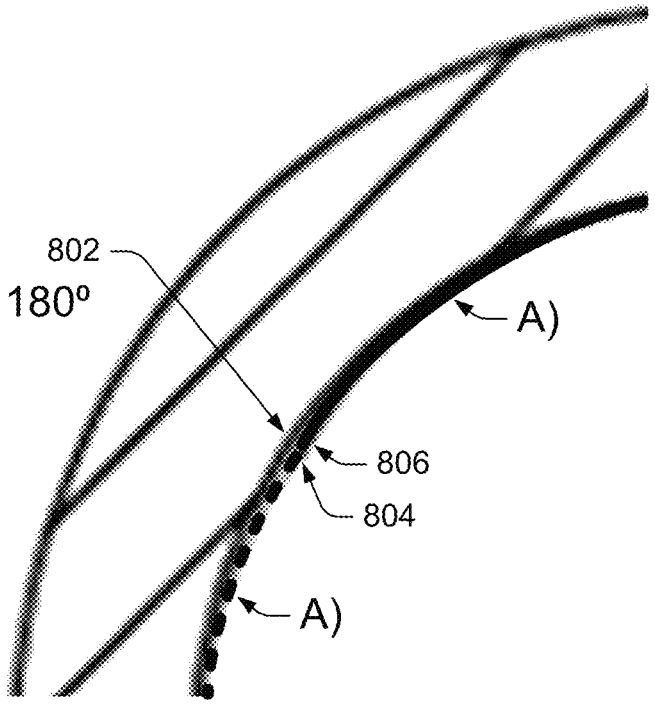
FIG. 8D shows a close detail view of the novel rifling of FIGS. 8A-8C, according to the second embodiment.

The cross-section of the twisted bore rifling 800 is formed by disposing a plurality of equal circles (E, F, and G), equally around the periphery of a bore 108 that has the same diameter (D) as the intended bullet 120 (as shown at FIG. 8B). For example, using the .22 caliber bullet 120 of FIG. 1B, the diameter of the bullet 120 is 0.223". Thus, the diameter (D) of the bore 108 and the circles (E, F, and G) for the twisted bore rifling 800 is also 0.223" for a .22 caliber firearm. For other calibers of firearms, the diameter (D) of the bore 108 for the twisted bore rifling 800 for the barrels 102 of those firearms corresponds to the diameter of the associated bullet 120 intended for the firearms. In some implementations, the equal circles (E, F, and G) have a diameter that is 0.0001" less than the diameter (D) of the intended bullet 120. For example, in the case of a .22 caliber bullet 120, the diameter of the bore 180 and the circles (E, F, and G) may be 0.2229".

Where the bullet 120 diameter for a particular caliber of firearm ammunition varies, the diameter (D) of the bore 108 for the twisted bore rifling 800 for the barrels 102 of those firearms can correspond to the diameter of each of the associated bullets 120 intended for the firearms. In other words, multiple barrel bores 108 can be manufactured, to match the ammunition that corresponds to it. Alternately, the diameter (D) of the bore 108 for the twisted bore rifling 800 for the barrels 102 of those firearms can correspond to the largest diameter, the median diameter, or the smallest diameter of the intended bullets 120.

As shown at FIGS. 8A-8D, a plurality of arc segments (A) alternating with the contact zones 802 results from an overlay of the equal circles (E, F, and G) with the bore 108. While three equal circles (E, F, and G) are illustrated and described herein, the scope of the disclosure also includes any quantity of equal circles and their associated arc segments (A). The quantity of contact zones 802 equals the quantity of circles overlaid.

Overlaying or superimposing the equal circles (E, F, and G) with the bore 108 and offsetting them (O) a few thousandths of an inch (e.g., between 1 and 10 thousandths) forms the contact zones 802, with "lobes" (L) between them. Each contact zone 802 is formed by joining the second end 806 of each arc segment (A) to the first end 804 of an adjacent arc segment (A) at an approximately 180° angle. Accordingly, the contact zones 802 encroach into the bore 108 the few thousandths of an inch corresponding to the offset (0). The midpoint of the lobes (L) remain flush with the outer diameter of the bore 108. The driving surface of the twisted bore rifling 800 is essentially the same as the driving surface of the claw rifling 700: an arc segment of a circle.

The equal circles (E, F, and G) spiral in a helix pattern (rotate around the perimeter of the bore 108 in cross-section) over the length of the barrel 102, while maintaining their relative spacing one to another. The offset (O) (in thousandths of an inch or less) of each of the equal circles (E, F, and G) to the bore 108 provides a non-compressive and non-expansive surface to the outer surface of the bullet 120, as the contact areas 802 rotate around the perimeter of the bore 108, gripping the bullet 120 and imparting a spin onto the bullet 120.

Various advantages of the twisted bore rifling pattern 800 include that it results in the least amount of bullet 120 distortion possible of any rifling ever made. The twisted bore form 800 is the closest to a perfect circle, ever made, while still imparting a spin on the bullet 120. It provides stability in the transition from supersonic to subsonic flight, allows for the use of any twist rate—fixed or variable, is specially designed for bullets 120 made from hard materials such as copper, uranium, titanium and similar materials that are less compressible than bullets 120 in common use today, allows for new manufacturing methods forms such as electromagnetic discharging and other emerging technologies, is well suited for the use of ceramics for heat and friction reduction and will lend itself to other emerging technologies and coatings, has been practically designed for use with long bullets 120 and bullets 120 having large bearing surfaces, it decreases friction, which provides increased velocities and performance increases with the higher velocities, and it does not deform the exterior of the bullet 120 as the axial point of the bullet 120 remains unchanged, enhancing the aerodynamics of flight.

Actual field trials have proven that the twisted bore rifling 800 significantly reduces the friction of the bullet 120 traveling down the bore 108. It has no rifling lands 110 to drag and erode away, so the first part of the barrel 102 that the bullet 120 enters is no more critical than any part of the barrel 102. Heat has a limited effect on the twisted barrel's bore 108 as the hot gases coming out of the cartridge do not pass across, around, and over a thin edge or edges (rifling lands 110) to erode them away. The gases and heat translate down the bore 108 on broad surfaces, lessening the effect of heat on the bore 108. Additional advantages will be apparent to one having skill in the art.

Although various implementations and examples are discussed herein, further implementations and examples may be possible by combining the features and elements of individual implementations and examples.

The subject matter of the present disclosure is described with specificity to meet statutory requirements. However, the description itself is not intended to limit the scope of this disclosure. Rather, the claimed or disclosed subject matter might also be embodied in other ways to include different components, steps, or combinations thereof similar to the ones described in this document, in conjunction with other present or future technologies. Terms should not be interpreted as implying any particular order among or between various steps disclosed herein unless and except when the order of individual steps is explicitly described.

For purposes of this disclosure, the word "including" has the same broad meaning as the word "comprising." In addition, words such as "a" and "an," unless otherwise indicated to the contrary, include the plural as well as the singular. Thus, for example, the constraint of "a feature" is satisfied where one or more features are present. Also, the term "or" includes the conjunctive, the disjunctive, and both (a or b thus includes either a or b, as well as a and b).

Conclusion

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. A gun barrel having circumferential rifling, comprising:

a bore of the gun barrel, the bore having an equal diameter as a diameter of a projectile for the gun barrel;

a first plurality of equal length arc segments equally distributed around the bore of the gun barrel as viewed in cross-section, wherein each arc segment of the first plurality of equal length arc segments has a same radius; and a second plurality of equal length stop segments as viewed in cross-section, each stop segment joins a second end of each arc segment to a first end of an adjacent arc segment at an angle greater than 135 degrees, and each stop segment has a length that is less than or equal to 1/50 of a length of each of the equal length arc segments, wherein the first plurality of equal length arc segments and the second plurality of equal length stop segments are helically disposed within the bore over a length of the gun barrel.

2. The gun barrel of claim 1, wherein the first end of each arc segment of the first plurality of equal length arc segments is flush with an inner surface of the bore.

3. The gun barrel of claim 1, wherein the second end of each arc segment is offset a predetermined distance toward an interior of the bore from the diameter of the bore.

4. The gun barrel of claim 3, wherein the predetermined distance is less than or equal to 10 thousandths of an inch.

5. The gun barrel of claim 1, wherein a radius of the first plurality of equal length arc segments is equal to a radius of the projectile for the gun barrel.

6. The gun barrel of claim 1, wherein the first plurality of equal length arc segments alternates with the second plurality of equal length stop segments around the bore, as viewed in cross-section.

7. The gun barrel of claim 1, wherein the first plurality of equal length arc segments comprises from 2 to 36 arc segments.

8. The gun barrel of claim 1, wherein each arc segment of the first plurality of equal length arc segments comprises a bearing surface that contacts an outer surface of the projectile and imparts a rotation on the projectile as the projectile moves down the length of the gun barrel.

9. The gun barrel of claim 1, wherein each stop segment of the second plurality of equal length stop segments has a linear profile when viewed in cross-section.

10. The gun barrel of claim 1, wherein each stop segment of the second plurality of equal length stop segments has a curved profile when viewed in cross-section.

11. A gun barrel having circumferential rifling, comprising:

a bore of the gun barrel, the bore having an equal diameter as a diameter of a projectile for the gun barrel;

a first plurality of equal length arc segments equally distributed around the bore of the gun barrel as viewed in cross-section, wherein each arc segment of the first plurality of equal length arc segments has a same radius; and a second plurality of equal length contact zones as viewed in cross-section, each contact zone formed by joining a second end of each arc segment to a first end of an adjacent arc segment at a 180° angle, wherein the first plurality of equal length arc segments and the second plurality of equal length contact zones are helically disposed within the bore over a length of the gun barrel.

12. The gun barrel of claim 11, wherein the arc segments of the first plurality of equal length arc segments comprise portions of an equal plurality of offset circles having a same diameter as the diameter of the bore, superimposed at the bore and offset a predetermined distance relative to the bore.

13. The gun barrel of claim 11, wherein the predetermined distance comprises a distance less than or equal to 10 thousands of an inch.

14. The gun barrel of claim 11, wherein a midpoint of each arc segment of the first plurality of arc segments is flush with the bore.

15. The gun barrel of claim 11, wherein each end of each arc segment of the first plurality of arc segments is offset a predetermined distance toward the interior of the bore.

16. The gun barrel of claim 11, wherein each arc segment of the first plurality of arc segments comprises a lobe and wherein each lobe is separated from an adjacent lobe by a contact zone.

17. The gun barrel of claim 11, wherein a radius of each arc segment of the first plurality of arc segments is less than a radius of the bore.

18. The gun barrel of claim 11, wherein the first plurality of equal length arc segments comprises three arc segments.

* * * * *